US010292549B2

(12) United States Patent
Kim

(10) Patent No.: US 10,292,549 B2
(45) Date of Patent: May 21, 2019

(54) FLUSH TOILET CAPABLE OF CORRECTING DEFECATION POSTURE

(71) Applicant: Seong Gyu Kim, Seoul (KR)

(72) Inventor: Seong Gyu Kim, Seoul (KR)

( * ) Notice: Subject to any disclaimer, the term of this patent is extended or adjusted under 35 U.S.C. 154(b) by 101 days.

(21) Appl. No.: 15/528,864

(22) PCT Filed: Mar. 7, 2017

(86) PCT No.: PCT/KR2017/002419

§ 371 (c)(1),
(2) Date: May 23, 2017

(87) PCT Pub. No.: WO2018/074676

PCT Pub. Date: Apr. 26, 2018

(65) Prior Publication Data

US 2018/0325337 A1 Nov. 15, 2018

(30) Foreign Application Priority Data

Oct. 18, 2016 (KR) ..... 10-2016-0134745

(51) Int. Cl.

| | |
|---|---|
| ***A47K 17/02*** | (2006.01) |
| ***A47K 13/10*** | (2006.01) |
| ***E03D 11/04*** | (2006.01) |
| ***A47K 13/28*** | (2006.01) |
| *A47K 17/00* | (2006.01) |

(52) U.S. Cl.

CPC ..... *A47K 17/028* (2013.01); *A47K 13/10* (2013.01); *A47K 17/02* (2013.01); *A47K 13/28* (2013.01); *A47K 2017/006* (2013.01); *E03D 11/04* (2013.01)

(58) Field of Classification Search

CPC ..... A47K 17/028; A47K 2017/006; A47K 13/10; A47K 13/28; E03D 11/04

USPC ..... 4/300

See application file for complete search history.

(56) References Cited

U.S. PATENT DOCUMENTS 1,155,885 A * 10/1915 Catchings ..... A47K 17/028 4/249

2,099,118 A * 11/1937 Kennedy ..... A47K 13/00 4/237

(Continued)

FOREIGN PATENT DOCUMENTS

KR 10-1196482 B1 11/2012

*Primary Examiner* — Janie M Loeppke

(74) *Attorney, Agent, or Firm* — Studebaker & Brackett PC

(57) ABSTRACT

A flush toilet capable of correcting a defecation posture, in which a seat disposed on a toilet main body for a user to sit is inclined on the top thereof such that the front where the user's thighs are placed is higher than the rear where the user's hips are placed. Accordingly, smooth defecation is allowed by preventing bending between the intestine and the anus in the body by correcting the posture of a user into a squatting posture such that an angle between the upper body and the thighs of the user is maintained between 35~50° as if the user were using a squat toilet. Therefore, defecation time is reduced and the user's legs are prevented from becoming numb, thereby improving satisfaction with defecation. Further, intestinal movement is activated during defecation, so smooth defecation is possible, and constipation, hemorrhoids, irritable bowel syndrome, cancers, and other colorectal diseases are prevented.

14 Claims, 9 Drawing Sheets

(56) References Cited

U.S. PATENT DOCUMENTS

| | | | | | |
|---|---|---|---|---|---|
| 2,243,264 | A * | 5/1941 | Stromblad | A47K 17/028 | 4/254 |
| 2,954,566 | A * | 10/1960 | Lottenberg | A47K 13/28 | 4/254 |
| 3,520,005 | A * | 7/1970 | Downes | A47K 13/00 | 4/234 |
| 4,175,294 | A * | 11/1979 | Boyd | A47K 13/24 | 4/234 |
| 4,254,514 | A * | 3/1981 | Sakamoto | A47K 13/00 | 4/234 |
| 5,311,617 | A * | 5/1994 | Ammatelli | A47K 13/00 | 4/237 |
| 5,553,334 | A * | 9/1996 | Hillman | A47K 13/10 | 4/249 |
| 5,809,583 | A * | 9/1998 | Pucciani | A47K 17/028 | 4/254 |
| 2009/0019629 | A1* | 1/2009 | Bakmadzhyan | E03D 11/02 | 4/420 |
| 2013/0174337 | A1* | 7/2013 | Fagre | A47K 17/028 | 4/254 |

* cited by examiner

FLUSH TOILET CAPABLE OF CORRECTING DEFECATION POSTURE

TECHNICAL FIELD

The present invention relates to a flush toilet capable of correcting a defecation posture and, more particularly, to a flush toilet that allows for smooth defecation by inducing smooth intestinal movement by lifting the user's thighs such that his/her knees are positioned high when he/she defecates.

BACKGROUND ART

In general, a flush toilet is a bowl that people sit on to get rid of waste liquid or solid liquid and is generally used in most lavatories.

FIG. 1 is a schematic view showing an example of using a flush toilet, and referring to FIG. 1, a flush toilet has a toilet seat enabling a user to sit on a bowl thereof so that a user evacuates while sitting on the toilet seat.

Further, the toilet seat is rotatably coupled to the bowl for men to easily urinate after lifting the toilet seat, if necessary.

According to toilet seats of the related art, since the tops are flat planes, when a user defecates, sitting on the toilet seat, the angle between the user's back and thighs is a right angle or at least 70 degrees or more.

When a user defecates in the posture with a right angle or at least 70 degrees or more between his/her back and the thighs, the portion between the intestine and the anus is bent, so the intestinal movement is interfered with, and the intestine is blocked, if serious.

Accordingly, when a user uses the flush toilets of the related art, defecation is not easy, so the user has to exert a larger force and takes a long time to defecate.

Therefore, there is a problem that since people repeatedly defecates in a sitting posture with a right angle on flush toilets for a long period of time, in serious cases, constipation, hemorrhoids, irritable bowel syndrome, cancers, and other colorectal diseases are caused.

DISCLOSURE

Technical Problem

An object of the present invention is to provide a toilet capable of correcting a defecation posture, the toilet allowing for smooth defecation by making a user assume a squatting posture as if he/she were using a squat toilet to prevent bending between the intestine and the anus in the body.

Technical Solution

In order to achieve the objects of the present invention, the present invention provides a flush toilet capable of correcting a defecation posture, in which a seat disposed on a toilet main body for a user to sit thereon is inclined on a top thereof such that a front where the user's thighs are placed is higher than a rear where the user's hips are placed.

The seat may be inclined to lift the thighs of a user sitting on the seat such that an angle between the upper body and the thighs of the user is maintained between 35~50°.

A rounded portion curved from the hips to the back of a user may be formed at a rear portion of the seat.

The rear end of the rounded portion may be lower than or at the same level as a front end of the inclined seat.

The seat may be hinged to a rear of a top of the toilet main body to be placed on or lifted from the top of the toilet main body, a ring-shaped seat support on which the seat is placed may be disposed on the top of the toilet main body, and a top of the seat support may be inclined such that a front where the user's thighs are placed is higher than a rear where the user's hips are placed.

The seat may be detachably disposed on the top of a toilet main body and hinged to the rear of the top of the toilet main body to be placed on or lifted from the top of the toilet main body.

The seat may be hinged to a rear of a top of the toilet main body to be placed on or lifted from the top of the toilet main body, a ring-shaped seat support on which the seat is placed may be disposed on the top of the toilet main body, and the flush toilet capable of correcting a defecation posture may further include a seat base fitted to the seat support and inclined such that a top becomes gradually higher as it goes forward.

The flush toilet may further include a feet seat unit disposed under the toilet main body to protrude forward and supporting the user's feet.

A pair of feet supports each having a feet seat on which a corresponding one of the user's feet is placed may protrude on the top of the feet seat unit, and the feet seats of the feet supports may decline from a front to the rear such that the user's ankles are bent inward.

A guide groove for guiding the feet seat unit forward and backward may be formed at both sides of the toilet main body and a projection moving forward and backward in the guide grooves may be formed at both sides of the feet seat unit; and stopper grooves or stoppers that are spaced from each other may be formed in each of the guide grooves, and a stopper formed to be inserted in the stopper grooves or a stopper groove for locking stoppers is formed on each of the projections.

The seat may be hinged to a rear of a top of the toilet main body to be placed on or lifted from the top of the toilet main body and a ring-shaped seat support on which the seat is placed may be disposed on the top of the toilet main body, and the flush toilet may further include: a seat support panel disposed under the seat to support a bottom of the seat and rotating about a hinge shaft of the seat; a seat angle adjuster disposed between the seat support panel and the seat support to adjust a slope of the seat support panel by lifting a front of the seat support panel; a feet seat unit actuator moving the feet seat unit forward and backward under the toilet main body; and a controller controlling the operation of the seat angle adjuster and the feet seat unit actuator.

The feet seat unit may have a foot plate rotatably coupled to a rear end of the feet seat unit by a hinge and supporting the soles of the feet on a top thereof, and the flush toilet may further include a foot plate angle adjuster adjusting an angle of the foot plate by lifting up or lowering a front of the foot plate.

The controller may control the seat and the foot plate so as to be oriented at the same angle by operating both of the seat angle adjuster and the foot plate angle adjuster.

The seat angle adjuster may be a first hydraulic cylinder of which a first end is rotatably coupled to the seat support and a second end is coupled to a bottom of the seat support panel, and the foot plate angle adjuster may be a second hydraulic cylinder having a first end rotatably coupled to a bottom of a front portion of the foot plate and a second end rotatably mounted inside the feet seat unit.

The feet seat unit may include: a feet seat body connected to a feet seat unit actuator to be moved forward and backward by the feet seat unit actuator; a lifting feet seat support disposed inside the feet seat body to be movable up and down and keeping the foot plate and the foot plate angle adjuster therein; and feet seat height adjusters disposed inside the feet seat body to move the lifting feet seat support up and down.

The controller may include: a switch button; a first lifting button for increasing the angle of the seat angle adjuster and a first descending button for decreasing the angle of the seat angle adjuster; a second lifting button for lifting the lifting feet seat support and a second descending button for descending the lifting feet seat support by operating the feet seat height adjusters; a storage for storing data about angles of the seat, angles of the foot plate, and heights of the feet seat body that are set by users; and a plurality of user selection switches for adjusting the angle of the seat, the angle of the foot plate, and the height of the feet seat body in accordance with the data of users stored in the storage.

Advantageous Effects

According to the present invention, it is possible to allow for smooth defecation by preventing bending between the intestine and the anus in the body by correcting the posture of a user into a squatting posture as if the user were using a squat toilet. Accordingly, defecation time is reduced and the user's legs are prevented from becoming numb, thereby improving satisfaction with defecation.

Further, intestinal movement is activated during defecation, so smooth defecation is possible, and constipation, hemorrhoids, irritable bowel syndrome, cancers, and other colorectal diseases are prevented.

Figure 1:
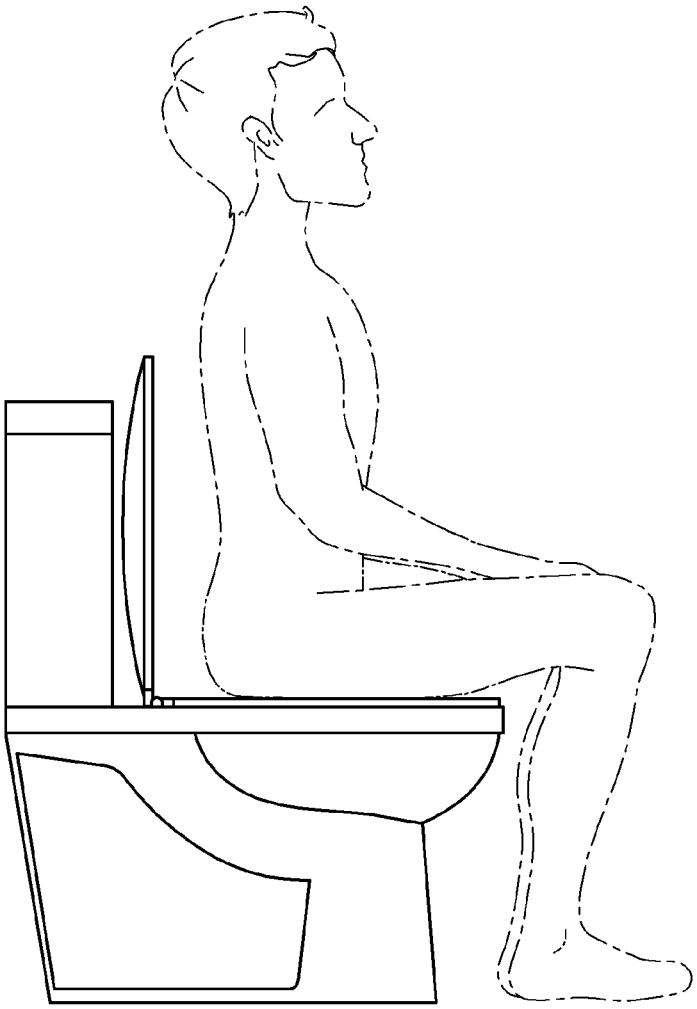
FIG. 1 (PRIOR ART)
FIG. 1 is a schematic view showing a flush toilet of the related art.

<Description of the Reference Numerals in the Drawings>

| | |
|---|---|
| 100: Toilet main body | 100a: Seat support |
| 100b: Water tank | 110: Seat |

-continued

<Description of the Reference Numerals in the Drawings>

| | |
|---|---|
| 111: Rounded portion | 120: Elastic member |
| 130: Guide groove | 131: Stopper groove |
| 200: Seat cover | 300: Feet seat unit |
| 301: Feet seat body | 302: Lifting feet seat support |
| 303: Feet seat height adjuster | 310: Feet support |
| 320: Projection | 321: Stopper |
| 330: Foot plate | 400: Seat base |
| 500: Seat support panel | 600: Seat angle adjuster |
| 610: First hydraulic cylinder | 700: Feet seat unit actuator |
| 800: Controller | 810: Switch button |
| 820: First lifting button | 830: First descending button |
| 840: Second lifting button | 850: Second descending button |
| 860: User selection button | 900: Foot plate angle adjuster |
| 910: Second hydraulic cylinder | |

Best Mode

Hereinafter, the present invention will be described in detail.

Exemplary embodiments of the present invention will be described hereafter in detail with reference to the accompanying drawings. Before describing the present invention in detail, it should be noted that the terminologies and terms used in the following description and claims should not be construed as being limited to the dictionary meanings. Therefore, the configurations described in the embodiments and drawings of the present invention are merely the most preferable embodiments but do not represent all of the technical spirit of the present invention. Thus, the present invention should be construed as including all the changes, equivalents, and substitutions included in the spirit and scope of the present invention at the time of filing this application.

Figure 2:
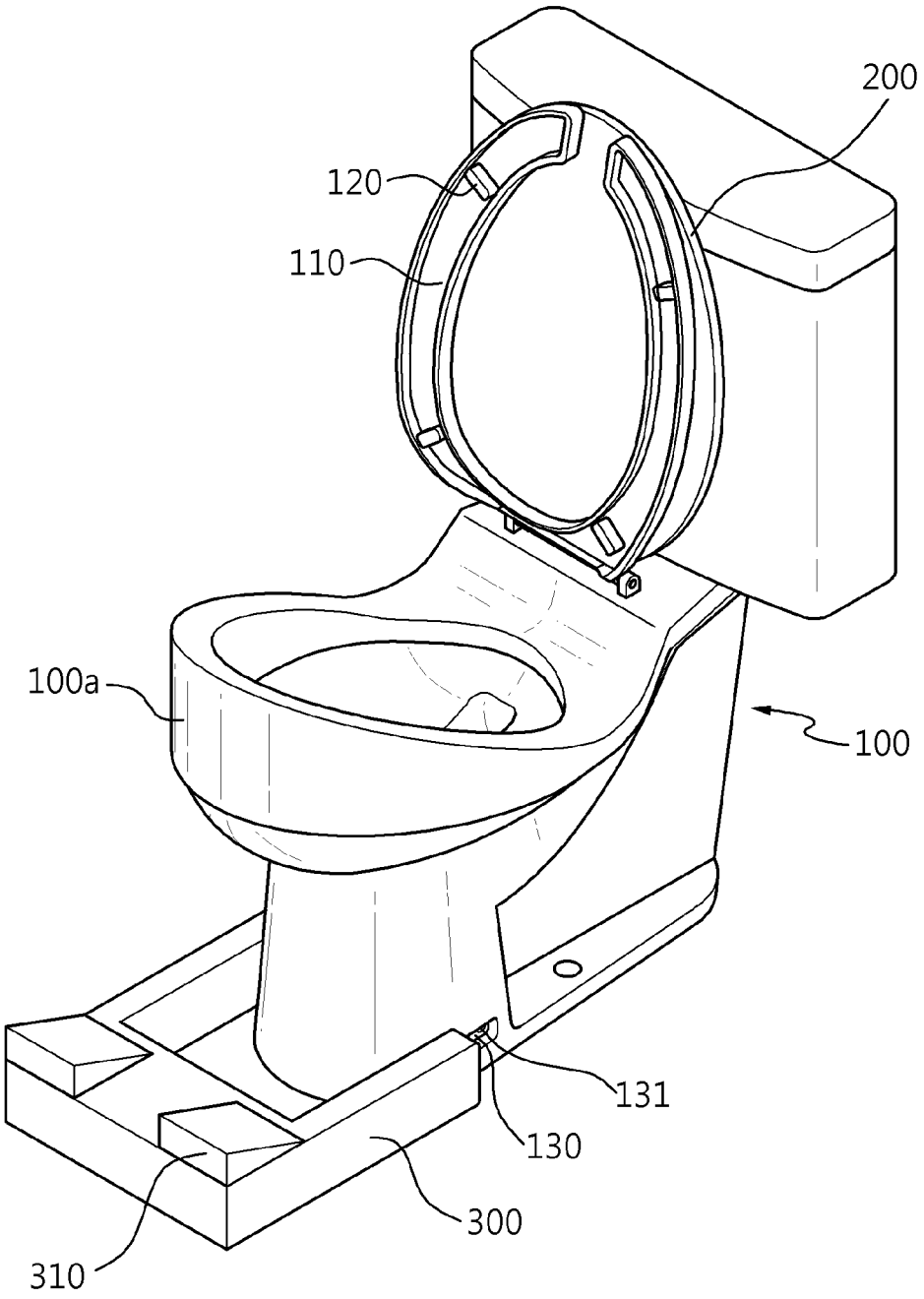
FIG. 2 is a perspective view showing a flush toilet capable of correcting a defecation posture according to an embodiment of the present invention.
Figure 3:
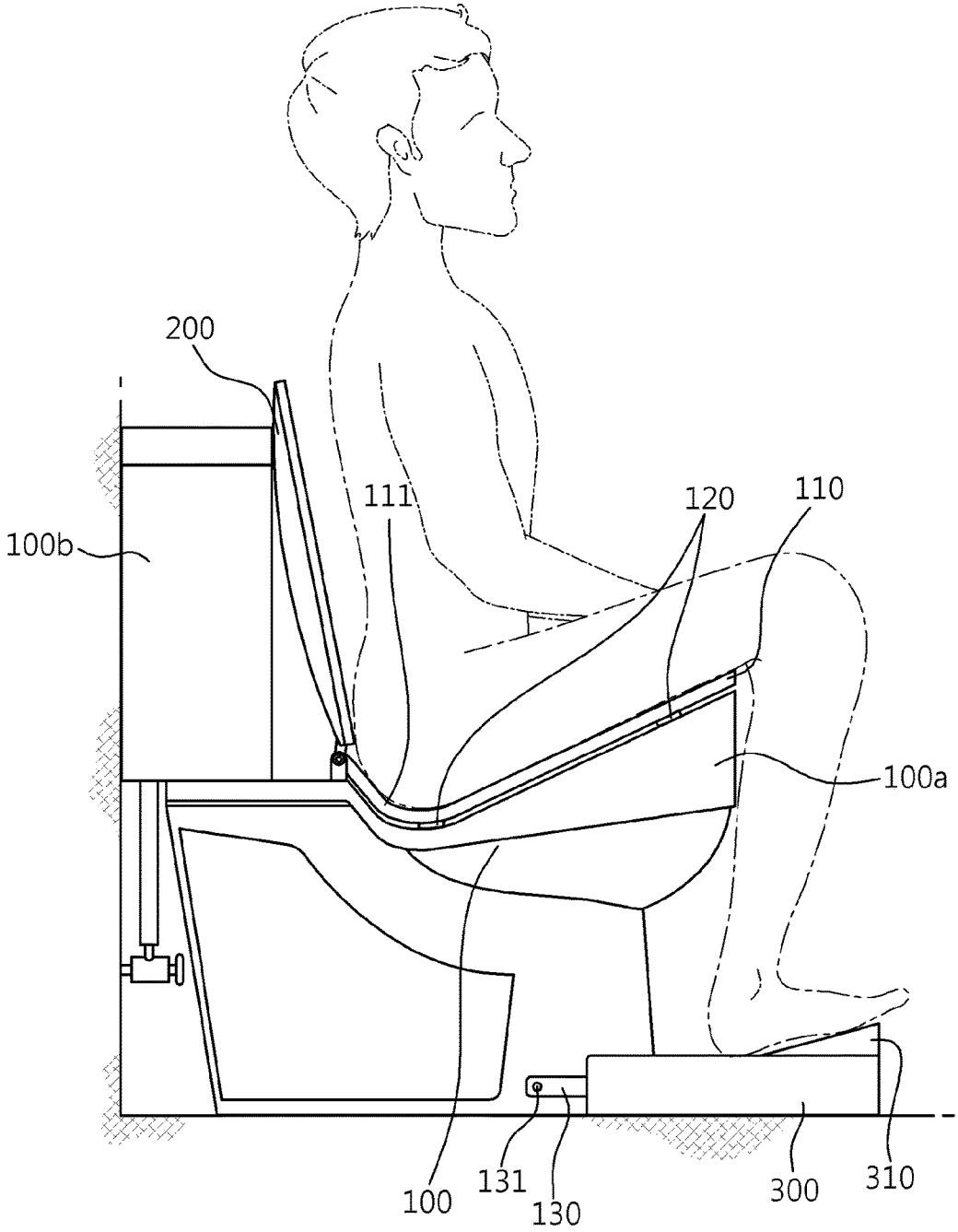
FIG. 3 is a side view showing a flush toilet capable of correcting a defecation posture according to an embodiment of the present invention.
Figure 4:
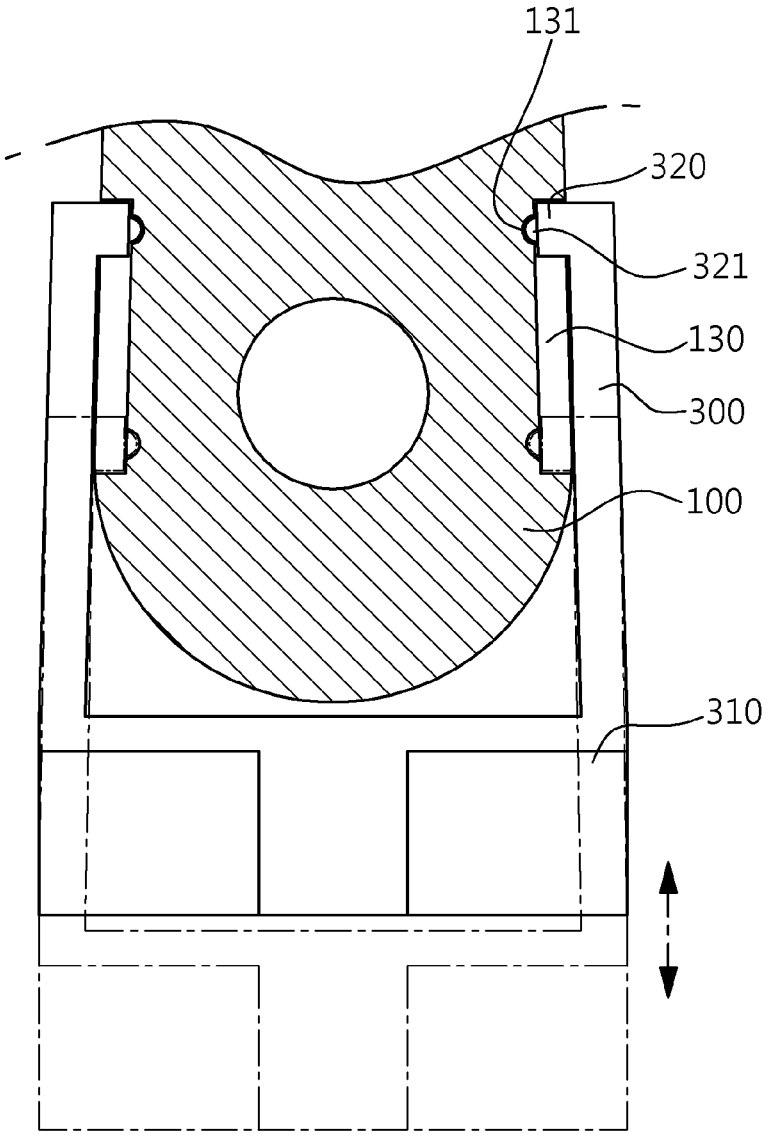
FIG. 4 is a cross-sectional view showing a feet seat unit of the flush toilet capable of correcting a defecation posture according to an embodiment of the present invention.

FIG. 2 is a perspective view showing a flush toilet capable of correcting a defecation posture according to an embodiment of the present invention and FIG. 3 is a side view showing a flush toilet capable of correcting a defecation posture according to an embodiment of the present invention.

Referring to FIGS. 2 and 3, a flush toilet capable of correcting a defecation posture according to the present invention includes a toilet main body 100, and the toilet main body has a space for receiving urine or excrement and retaining a certain amount of water therein and has an outlet for discharging the water with the urine or excrement therein.

It should be noted that the toilet main body may be formed in various shapes known in the art that can receive urine or excrement.

The toilet main body 100 may further include a water tank 100*b* that can store water at the rear side and the water tank 100*b* is well known as the water tanks of common flush toilets, so the detailed description is not provided.

The toilet main body 100 has a seat 110 on which a user can sit and the seat 11 is hinged to the rear portion of the top of the toilet main body 100 so that it can be lifted or placed on the toilet main body 100.

Although the seat 110 is manufactured separately from the toilet main body 100 and hinged to the rear portion of the top of the toilet main body 100 in the embodiment shown in the figures, it may be integrally formed on the top of the toilet main body 100.

A ring-shaped seat support 100*a* where the seat 110 is placed is formed on the toilet main body 100 and the seat 110 is placed on the seat support 100*a* and has a hole in the center to pass urine or excrement.

The flush toilet capable of correcting a defecation posture according to an embodiment of the present invention may further include a seat cover 200 that is hinged to the top of the toilet main body 100 to cover the hole by covering the top of the seat 110.

The seat cover 200 is convex in the center portion with smooth slopes around the center portion, so water for cleaning the toilet flows down along the slopes. Accordingly, the time for cleaning is reduced and an advantage is conferred in terms of cleanliness.

The most remarkable characteristic of the flush toilet capable of correcting a defecation posture according to the present invention is that the seat 110 is inclined such that the front portion is higher than the rear portion on the top.

That is, in detail, the seat 110 is inclined on the top such that the front where the thighs are placed is higher than the rear where the hips are placed so that the angle between the upper body and the thighs of a user is maintained between 35~50° when the user sits on the seat 110 by lifting the thighs; for example, the slope is 10~15°.

Accordingly, the angle between the user's upper body and the thighs is maintained at 35~50° in a squatting posture as if he/she were using a squat toilet, so bending between the intestine and the anus in the body during defecation is prevented, thereby allowing for smooth defecation.

According to the flush toilet capable of correcting a defecation posture of the present invention, since the ring-shaped seat support 100*a* formed on the top of the toilet main body 100 to support the seat 110 is inclined such that the height becomes gradually increased as it goes forward, the top of the toilet main body 100 can stably support the seat 110 inclined such that the height becomes gradually increased as it goes forward.

Further, since the seat support 100*a* is inclined such that the height becomes gradually increased as it goes forward, when the flat seat 110 is placed on the seat support 100*a*, the top of the seat 110 can be inclined such that the front where thighs are positioned is higher than the rear where the hips are positioned.

According to the flush toilet capable of correcting a defecation posture of the present invention, the seat 110 may be integrally formed with the toilet main body 100 so as not to be separated from the top of the toilet main body 100 such that the top of the toilet main body 100 becomes gradually higher as it goes forward.

An elastic member 120 is disposed between the seat 110 and the seat support 100*a* to improve a cushion effect so that a user can feel comfortable when sitting on the seat 110 and so that a shock when the seat 110 is placed on the seat support 100*a* can be absorbed.

For example, a plurality of elastic members 120 is disposed at a predetermined distance from each other on any one of the bottom of the seat 110 and the top of the seat support 100*a*.

A rounded portion 111 curved from the hips to the back of a user is formed at the rear end of the seat 110 to be able to stably support the rear portion of the hips of a user between the rear portion of the hips to the back of a user.

Since the rounded portion 111 is curved between the rear end of the hips and the back of a user and stably supports the rear portion of the user's hips, the user can feel comfortable with the thighs lifted when sitting on the seat 110.

The rear end of the rounded portion 111 is lower than or at the same level as the front end of the inclined seat 110 to stably support the hips of a user where his/her weight is concentrated, so the user can experience a squatting posture with his/her thighs lifted.

The flush toilet capable of correcting a defecation posture of the present invention further includes a feet seat unit 300 disposed under and ahead of the toilet main body 100 to support the user's feet.

Feet supports 310 having a feet seat on which the user's feet are placed protrude from the top of the feet seat unit 300 and the feet seats of the feet supports 310 are inclined such that the user's ankles are bent inward.

The feet supports 310 are provided in pairs and spaced apart from each other on the top of the feet seat unit to be able to support both feet of a user.

The feet seat unit 300 supports the user's feet on the feet supports 310 with his/her toes lifted so that the user can comfortably sit on the seat 110 with his/her thighs lifted, thereby minimizing discomfort when the user sits on the seat 110.

The feet seat unit 300 is coupled to the toilet main body 100 and can be moved forward/backward, so a user can draw out the feet seat unit 300 only when he/she needs it.

In detail, a guide groove 130 for guiding the feet seat unit 300 forward/backward is formed at both sides of the toilet main body 100 and a projection 320 moving forward/backward in the guide groove 130 is formed at both sides of the feet seat unit 300.

Further, stopper grooves 131 or stoppers 321 that are spaced apart from each other may be formed in each of the guide grooves 130, and a stopper 321 formed to be inserted in the stopper grooves 131 or a stopper groove 131 for locking the stoppers 321 may be formed on each of the projections 320.

For example, stopper grooves 131 or stoppers 321 are formed in or on the guide grooves 130 at the maximum drawing-out position and the maximum inserted position of the feet seat unit 300 to correspond to stoppers 321 or stopper grooves 131 on or in the projections 320.

When the stoppers 321 are inserted into the stopper grooves 131, they can be pulled out by a predetermined force or more.

That is, the stoppers 321 and the stopper grooves 131 may be modified in various ways as long as the stoppers 321 can be pulled out of the stopper grooves 131 and moved under a predetermined force or more so that the feet seat unit 300 is moved, and they can hold the feet seat unit 300 under a predetermined force or less.

According to the present invention, for example, stopper grooves 131 spaced apart from each other are formed in each of the guide grooves 130 and a stopper 320 is formed on each of the projections 320 to be inserted into the stopper grooves 131, in which the stoppers 321 and the stopper grooves 131 are formed in a semicircular shape to correspond to each other.

When the feet seat unit 300 is maximally drawn out or in, it cannot be moved by the stoppers 321 inserted and locked in the stopper grooves 131. Further, by pulling out or pushing in the feet seat unit 300 with a force that can separate the stoppers 321 out of the stopper grooves 131, the feet seat unit 300 can be drawn out to be used or stowed inside under the toilet main body.

It should be noted that the feet seat unit 300 can be separated from the toilet main body 100, so it can be used for another flush toilet as well as flush toilets of the related art.

Figure 5:
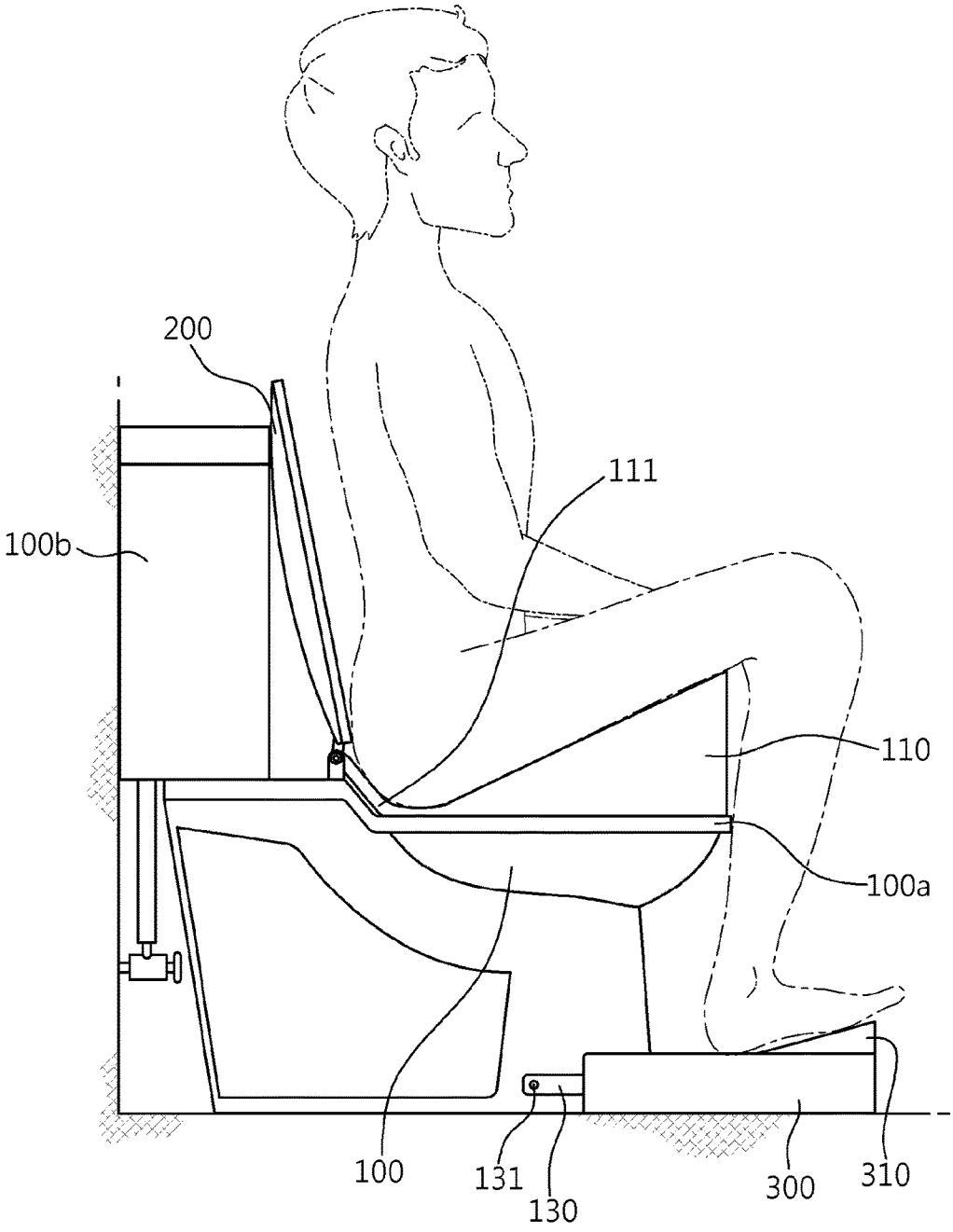
FIG. 5 is a side view showing a flush toilet capable of correcting a defecation posture according to another embodiment of the present invention.

FIG. 5 is a side view showing a flush toilet capable of correcting a defecation posture according to another embodiment of the present invention, in which a seat 110 is detachably disposed on the top of a toilet main body 100 and hinged to the rear of the top of the toilet main body 100 to be placed on or lifted from the top of the toilet main body 100.

That is, the seat 110 is inclined on the top such that the front where the user's thighs are placed is higher than the rear where the user's hips are placed and has a rounded portion 111 curved from the rear end that the user's thighs come in contact with, to the portion corresponding to the user's back. Further, the seat 110 can be separated from the top of the toilet main body 100 and can be used for another flush toilet.

Figure 6:
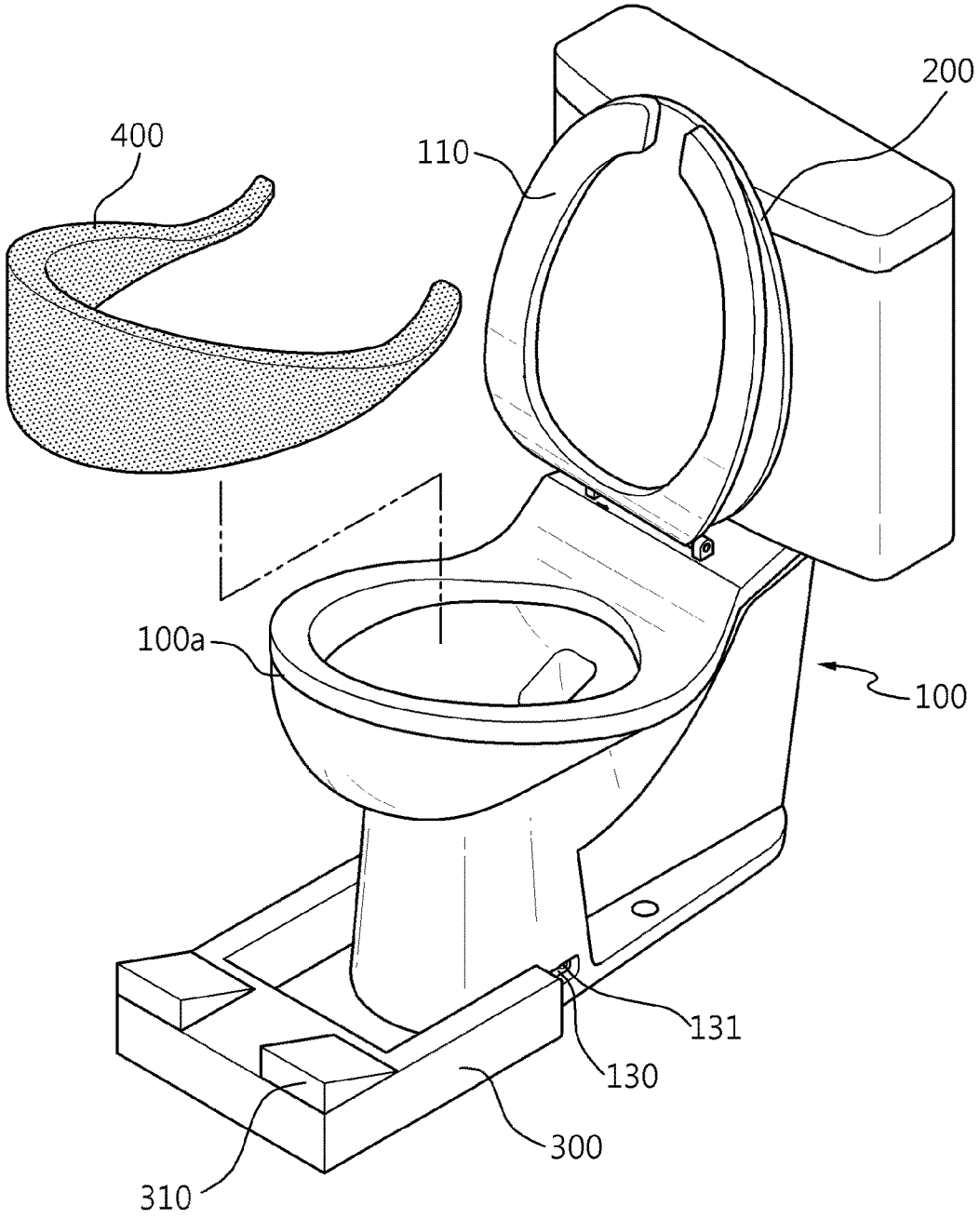
FIG. 6 is a perspective view showing the flush toilet capable of correcting a defecation posture according to another embodiment of the present invention.
Figure 7:
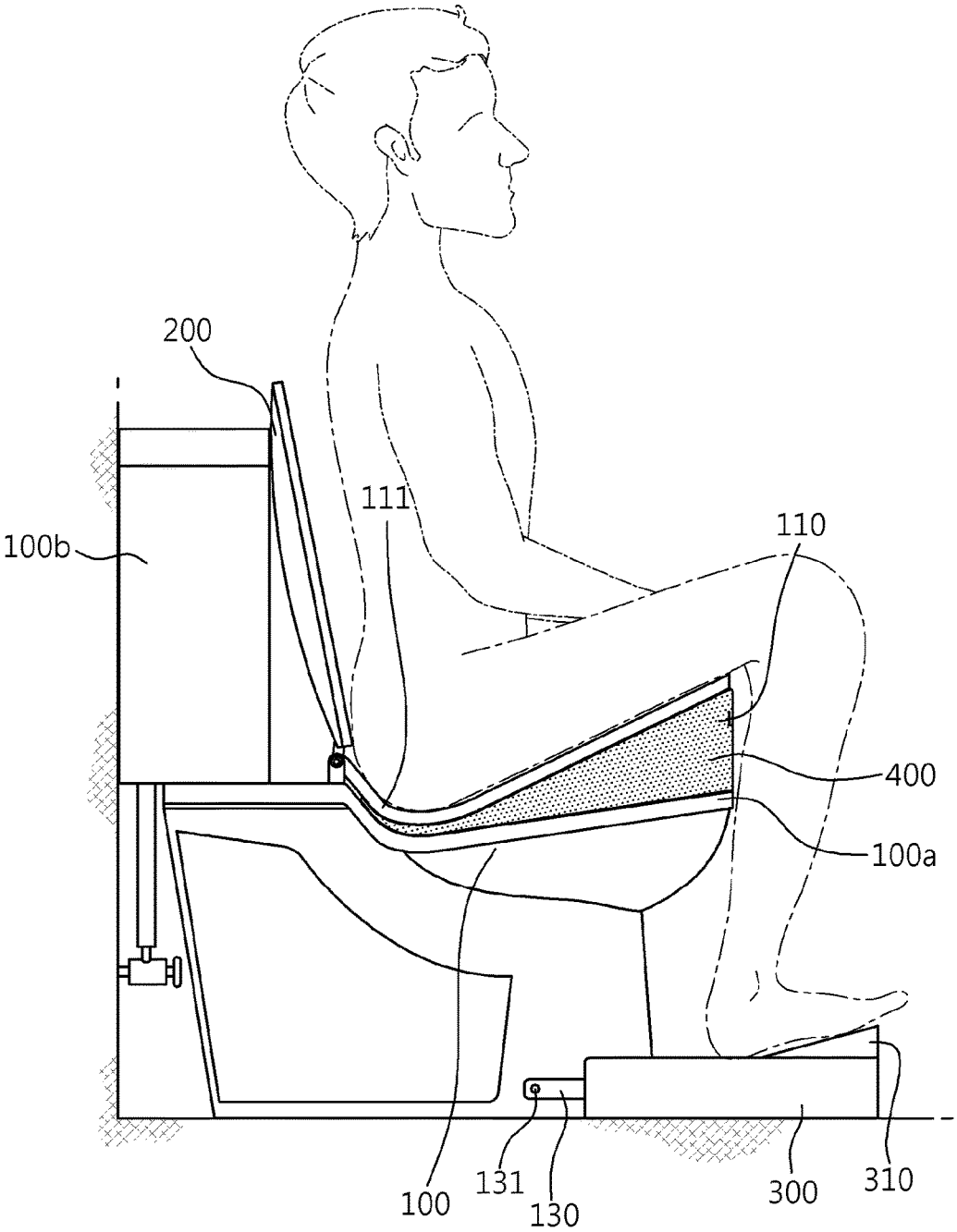
FIG. 7 is a side view showing the flush toilet capable of correcting a defecation posture according to another embodiment of the present invention.

FIG. 6 is a perspective view showing a flush toilet capable of correcting a defecation posture according to another embodiment of the present invention and FIG. 7 is a side view showing the flush toilet capable of correcting a defecation posture according to the embodiment of the present invention.

A flush toilet capable of correcting a defecation posture according to another embodiment of the present invention may further include a seat base 400 that is inclined such that the top becomes gradually higher as it goes forward, and is coupled to the seat support 100*a*.

The seat base 400 is formed in a ring shape corresponding to the seat support 100*a* and has a groove in the bottom for fitting the seat support 100*a*, so the seat support 100*a* is fitted in the groove.

The seat base 400 is formed in a ring shape corresponding to the seat support 100*a*.

The seat base 400 may be inclined such that the top of the flat seat 110 placed on the seat base 400 is higher at the front where the user's thighs are placed than the rear where the user's hips are placed.

The seat base 400 is made of synthetic rubber or urethane and is strong enough to be able to stably support the weight of a user with the thighs positioned at the front higher than the hips at the rear, so it can absorb a portion of the shock and make a user comfortable when he/she sits on the seat.

Further, the seat base 40 can be coupled to the seat support 100*a* of an existing flush toilet, so it is possible to correct a user's defecation posture even without replacing the existing flush toilet.

Figure 8:
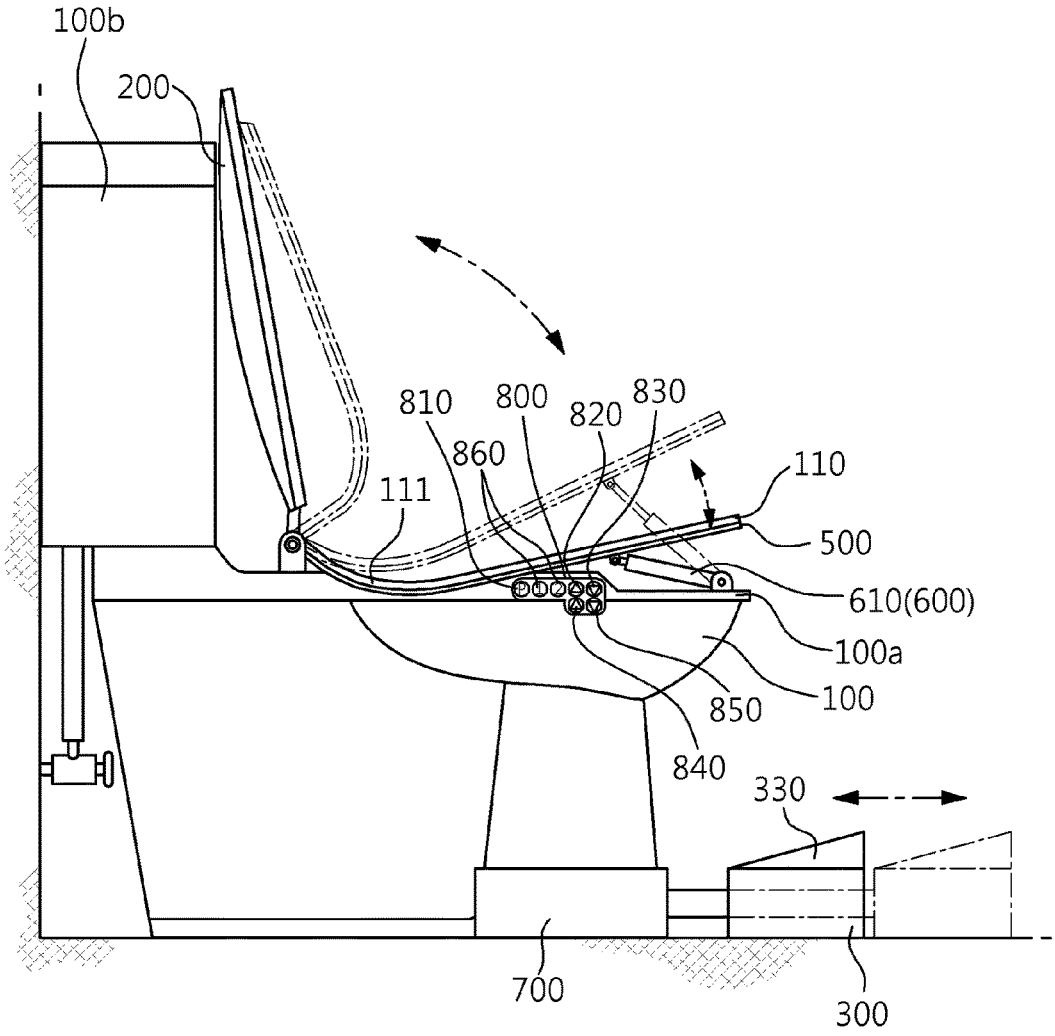
FIG. 8 is a side view showing the flush toilet capable of correcting a defecation posture according to another embodiment of the present invention.
Figure 9:
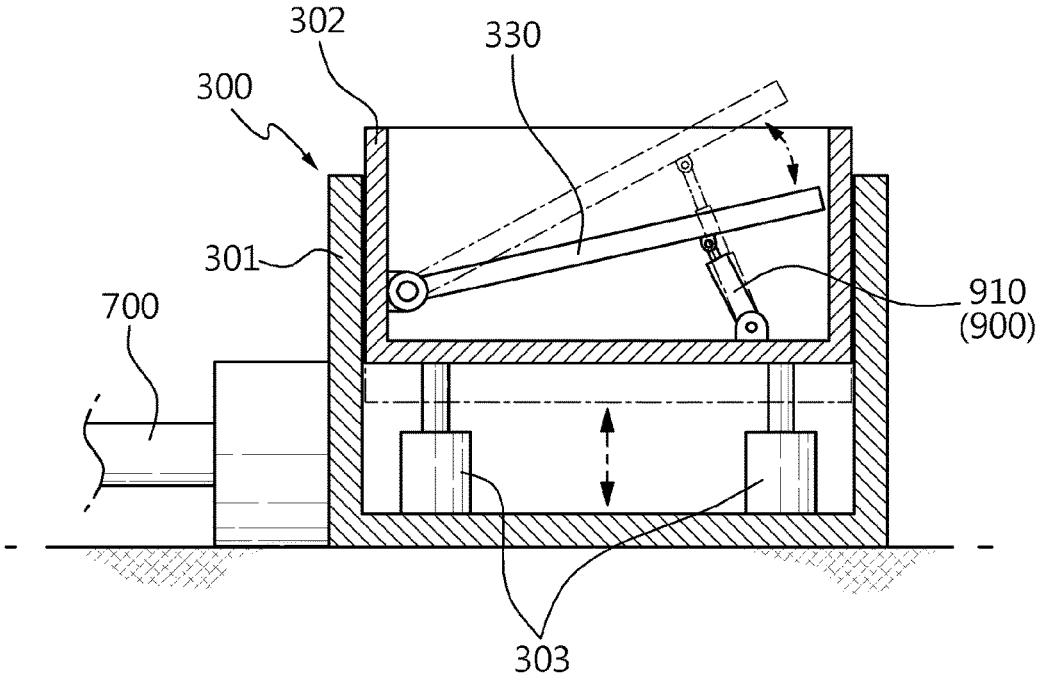
FIG. 9 is an enlarged view showing a feet seat unit of the flush toilet capable of correcting a defecation posture according to another embodiment of the present invention.

FIG. 8 is a perspective view showing a flush toilet capable of correcting a defecation posture according to another embodiment of the present invention and FIG. 9 is an enlarged cross-sectional view showing a feet seat unit 300 of the flush toilet capable of correcting a defecation posture according to the embodiment of the present invention.

Referring to FIGS. 8 and 9, the flush toilet capable of correcting a defecation posture according to another embodiment of the present invention may further include: a seat support panel 500 that is disposed under the seat 110 to support the bottom of the seat 110 and is rotated about the hinge shaft of the seat 110; a seat angle adjuster 500 that is disposed between the seat support panel 500 and the seat support 100*a* to adjust the slope of the seat support panel 500 by lifting the front of the seat support panel 500; a feet seat unit actuator 700 that moves the feet seat unit 300 forward/backward under the toilet main body 100; and a controller 800 that controls the operation of the seat angle adjuster 600 and the feet seat unit actuator 700.

The seat angle adjuster 600 may be a first hydraulic cylinder 610, of which a first end is rotatably coupled to the seat support 100*a* and a second end is coupled to the bottom of the seat support panel 500. That is, the first end of the first hydraulic cylinder 610 may be rotatably coupled to the seat support 100*a* and an end of a piston rod that reciprocates straight may be rotatably coupled to the bottom of the seat 110.

The two ends of the first hydraulic cylinder 610 are coupled to the bottom of the seat 110 and the top of the seat support 100, respectively, by ball joints to be smoothly operated.

The first hydraulic cylinder 610 adjusts the slope angle of the seat 110 by lifting up or lowering the front of the seat support 100*a* using the piston rod that reciprocates straight.

Further, the feet seat unit 300 has a foot plate 330 that is rotatably coupled to the rear end of the feet seat unit through a hinge and supports the soles of feet on it, and the flush toilet capable of correcting a defecation posture according to another embodiment of the present invention may further include a foot plate angle adjuster 900 that adjusts the angle of the foot plate 330 by lifting up or lowering the front of the foot plate 330.

The foot plate angle adjuster 900 may be a second hydraulic cylinder 910 that has a first end rotatably coupled to the bottom of the front portion of the foot plate 330 and a second end rotatably mounted inside the feet seat unit 300.

The foot plate 330 has a hinge at the rear end that is rotatably coupled to the foot plate 300 and an end of the foot plate angle adjuster 900, that is, an end of the piston rod of the second hydraulic cylinder 910 is rotatably coupled to the bottom of the front portion of the foot plate 330.

That is, the first end of the second hydraulic cylinder 910 may be rotatably coupled inside the feet seat unit 300 and an end of a piston rod that reciprocates straight may be rotatably coupled to the bottom of the foot plate 330.

Since the seat angle adjuster 600 and the foot plate angle adjuster 900 are the first hydraulic cylinder 610 and second hydraulic cylinder 910, which are controlled through hydraulic lines, electrical wires can be minimized and the adjusters can be stably operated in a flush toilet installed in a bathroom or a lavatory with a large amount of water and humidity.

The foot plate angle adjuster 900 is connected to the controller 800 to be controlled by the controller 800.

The foot plate 330 is inclined with the front lifted such that the user's ankles are bent inward with the toes up and has the same slope as the seat 110 so that when the user's thigh are lifted, the user's feet can be lifted at the same angle. Accordingly, stability can be maximized when a user sits on the seat 110 and the user can feel as comfortable as possible when sitting on the seat 110.

The controller 800 includes a switch button 810, a first lifting button 820 for increasing the angle of the seat angle adjuster 600, and a first descending button 830 for decreasing the angle of the seat angle adjuster 600. When the seat angle adjuster 600 is operated, the foot plate angle adjuster 900 is also operated, so the slope of the seat 110, which is adjusted by the seat angle adjuster 600, and the slope of the foot plate 300, which is adjusted by the foot plate angle adjuster 900, are controlled to be the same.

The switch button 810 is provided to turn on/off the controller 800. When the controller 800 is turned on by pressing the switch button 810 and the feet seat unit actuator 700 is operated, the feet seat unit 300 is moved forward to be able to support the user's feet.

Before the controller 800 is turned off by pressing the switch button 810, the controller 800 draws back the feet seat unit 300 to the initial position under the toilet main body 100 and is then turned off.

That is, the angles of the seat angle adjuster 600 and the foot plate angle adjuster 900 are controlled by the controller 800 such that the seat 110 and the foot plate 330 are inclined at the same angle.

The feet seat unit 300 may include: a feet seat body 301 connected to the feet seat unit actuator 700 to be moved forward/backward by the feet seat unit actuator 700; a lifting feet seat support 302 disposed inside the feet seat body 301 to be movable up and down and keeping the foot plate 330 and the foot plate angle adjuster 900 therein; and feet seat height adjusters 303 disposed inside the feet seat body 301 to move up/down the lifting feet seat support 302.

The feet seat height adjusters 303 may be hydraulic cylinders and are connected to the controller 800 to be controlled by the controller 800.

The controller may further include a second lifting button 840 for lifting the lifting feet seat support 302 and a second descending button 850 for descending the lifting feet seat support 302 by operating the feet seat height adjusters 303.

The feet seat height adjusters 303 adjust the height of the feet seat body 301 in accordance with the user's height so that the user's feet can be stably placed on the foot plate 330 when the user sits on the seat.

Further, the controller 800 includes a storage that keeps data about angles of the seat 110, angles of the foot plate 330, and heights of the feet seat body 301 that are suitable for users, and may further include a plurality of user selection switches 860 for adjusting the angle of the seat 110, the angle of the foot plate 330, and the height of the feet seat body 301 in accordance with the data of users stored in the storage.

A user stores data about an angle of the seat 110, an angle of the foot plate 330, and a height of the feet seat body 301 that are suitable for himself/herself by adjusting the angle of the seat 110, the angle of the foot plate 330, and the height of the feet seat body 301 that are suitable for himself/herself and then pressing any one of the user selection switches 860 for a predetermined time or longer.

When the user selection switches 860 are pressed shorter than the predetermined length of time for storing data, the angle of the seat 110, the angle of the foot plate 330, and the height of the feet seat body 301 are adjusted to correspond to the stored data.

In greater detail, when the user later presses the user selection switch 860 for his/her data, the controller 800 operates the seat angle adjuster 600, the foot plate angle adjuster 900, and the height of the feet seat height adjuster 303 so that the angle of the seat 110, the angle of the feet seat unit 330, and the height of the feet seat body 301 are adjusted to correspond to the stored data.

According to the present invention, it is possible to allow for smooth defecation by preventing bending between the intestine and the anus in the body by correcting the posture of a user into a squatting posture as if the user were using a squat toilet. Accordingly, the defecation time is reduced and the user's legs are prevented from becoming numb, thereby improving satisfaction with defecation.

Further, according to the present invention, intestinal movement is activated during defecation, so smooth defecation is possible, and constipation, hemorrhoids, irritable bowel syndrome, cancers, and other colorectal diseases are prevented.

It should be noted that the present invention is not limited to the embodiments and may be modified in various ways without departing from the spirit of the present invention, and the modifications are included in the present invention.

What is claimed is:

1. A flush toilet capable of correcting a defecation posture, comprising:

a seat disposed on a toilet main body for a user to sit and inclined on a top thereof such that a front where thighs of the user are placed is higher than a rear where hips of the user are placed, wherein the seat is hinged to a rear of a top of the toilet main body to be placed on or lifted from the top of the toilet main body;

a feet seat unit disposed under the toilet main body to protrude forward and supporting feet of the user;

a ring-shaped seat support disposed on the top of the toilet main body, the seat is placed on the seat support;

a seat support panel disposed under the seat to support a bottom of the seat and rotating about a hinge shaft of the seat;

a seat angle adjuster disposed between the seat support panel and the ring-shaped seat support to adjust a slope of the seat support panel by lifting a front of the seat support panel;

a feet seat unit actuator moving the feet seat unit forward and backward under the toilet main body; and a controller controlling operations of the seat angle adjuster and the feet seat unit actuator.

2. The flush toilet of claim 1, wherein the seat is inclined to lift the thighs of the user sitting on the seat such that an angle between the upper body and the thighs of the user is maintained between 35~50°.

3. The flush toilet of claim 1, wherein a rounded portion curved from the hips of the user to a back of the user is formed at a rear portion of the seat.

4. The flush toilet of claim 3, wherein the rear end of the rounded portion is lower than or at the same level as a front end of the inclined seat.

5. The flush toilet of claim 1, wherein the seat is hinged to a rear of a top of the toilet main body to be placed on or lifted from the top of the toilet main body, a ring-shaped seat support on which the seat is placed is disposed on the top of the toilet main body, and a top of the seat support is inclined such that a front where the user's thighs are placed is higher than a rear where the user's hips are placed.

6. The flush toilet of claim 1, wherein the seat is detachably disposed on a top of the toilet main body and is hinged to a rear of the top of the toilet main body to be placed on or lifted from the top of the toilet main body.

7. The flush toilet of claim 1, wherein the seat is hinged to a rear of a top of the toilet main body to be placed on or lifted from the top of the toilet main body, a ring-shaped seat support on which the seat is placed is disposed on the top of the toilet main body, and the flush toilet further includes a seat base fitted to the seat support and inclined such that a top becomes gradually higher as it goes forward.

8. The flush toilet of claim 1, wherein a pair of feet supports having a feet seat on which the feet of the user are placed protrudes on a top of the feet seat unit, and the feet seat of the feet supports decline from a front to the rear such that ankles of the user are bent inward.

9. The flush toilet of claim 8, wherein a guide groove for guiding the feet seat unit forward and backward is formed at both sides of the toilet main body and a projection moving forward and backward in the guide grooves is formed at both sides of the feet seat unit, and stopper grooves or stoppers that are spaced apart from each other are formed in each of the guide grooves, and a stopper formed to be inserted in the stopper grooves or a stopper groove for locking stoppers is formed on each of the projections.

10. The flush toilet of claim 1, wherein the feet seat unit has a foot plate rotatably coupled to a rear end of the feet seat unit through a hinge and supporting soles of feet on a top thereof, and the flush toilet further includes a foot plate angle adjuster adjusting an angle of the foot plate by lifting up or lowering a front of the foot plate.

11. The flush toilet of claim 10, wherein the controller controls the seat and the foot plate to be oriented at the same angle by operating both of the seat angle adjuster and the foot plate angle adjuster.

12. The flush toilet of claim 10, wherein the seat angle adjuster is a first hydraulic cylinder of which a first end is rotatably coupled to the seat support and a second end is coupled to a bottom of the seat support panel, and the foot plate angle adjuster is a second hydraulic cylinder having a first end rotatably coupled to a bottom of a front portion of the foot plate and a second end rotatably mounted inside the feet seat unit.

13. The flush toilet of claim 10, wherein the feet seat unit includes:

a feet seat body connected to a feet seat unit actuator to be moved forward and backward by the feet seat unit actuator;

a lifting feet seat support disposed inside the feet seat body to be movable up and down and keeping the foot plate and the foot plate angle adjuster therein; and feet seat height adjusters disposed inside the feet seat body to move the lifting feet seat support up and down.

14. The flush toilet of claim 13, wherein the controller includes:

a switch button;

a first lifting button for increasing an angle of a seat angle adjuster and a first descending button for decreasing the angle of the seat angle adjuster;

a second lifting button for lifting the lifting feet seat support and a second descending button for descending the lifting feet seat support by operating the feet seat height adjusters;

a storage for storing data about angles of the seat, angles of the foot plate, and heights of the feet seat body that are set by users; and a plurality of user selection switches for adjusting the angle of the seat, the angle of the foot plate, and the height of the feet seat body in accordance with the data of users stored in the storage.

* * * * *